US006244337B1

(12) United States Patent
Cumming et al.

(10) Patent No.: US 6,244,337 B1
(45) Date of Patent: Jun. 12, 2001

(54) SYSTEM FOR SEALING THE INTERSECTION BETWEEN A PRIMARY AND A BRANCH BOREHOLE

(75) Inventors: Francis Alexander Cumming; Simon Lawrence Fisher; Wilhelmus Christianus Maria Lohbeck, all of Rijswijk (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/216,168

(22) Filed: Dec. 18, 1998

(30) Foreign Application Priority Data

Dec. 31, 1997 (EP) ..... 97204147

(51) Int. Cl.[7] ..... E21B 33/00
(52) U.S. Cl. ..... 166/117.6; 166/50
(58) Field of Search ..... 277/322, 323, 277/325; 405/133, 150.1, 152, 231, 251; 166/50, 117.5, 117.6

(56) References Cited

U.S. PATENT DOCUMENTS 5,311,936 * 5/1994 McNair et al. .
5,526,880 * 6/1996 Jordan, Jr. et al. .
5,651,415 * 7/1997 Scales .
5,730,221 * 3/1998 Longbottome et al. .
5,787,987 * 8/1998 Forsyth et al. .
5,941,308 * 8/1999 Malone et al. .
5,944,107 * 8/1999 Ohmer .
6,015,012 * 1/2000 Reddick .
6,065,543 * 5/2000 Gano et al. ..... 166/50 X
6,092,602 * 7/2000 Gano ..... 166/50 X

FOREIGN PATENT DOCUMENTS 0 859 121 A2 8/1998 (EP) .
2297779 8/1996 (GB) .
98/09049 5/1998 (WO) .
98/09054 5/1998 (WO) .

* cited by examiner

*Primary Examiner*—Anthony Knight
*Assistant Examiner*—Karlena D Schwing

(57) ABSTRACT

A system for sealing the intersection between a primary borehole and a branch borehole comprises a primary casing section located in the primary borehole in the region of the branchpoint, and a branch casing section located in the branch borehole and secured to the primary casing section. The primary casing section is tubular and defines a slant surface which intersects a central axis of the primary casing section at an acute angle, so that the primary casing section can be pressed towards the branchpoint by means of a hollow whipstock or other wedge-shaped element.

6 Claims, 2 Drawing Sheets

SYSTEM FOR SEALING THE INTERSECTION BETWEEN A PRIMARY AND A BRANCH BOREHOLE

FIELD OF THE INVENTION

The invention relates to a system for sealing the intersection between a primary borehole and a branch borehole.

BACKGROUND OF THE INVENTION

Numerous systems are known to provide such sealing.

U.S. Pat. No. 2,379,070 discloses a system which comprises a tubular primary casing section which in use is located in the primary borehole in the region of the branchpoint and a branch casing section which is welded to the primary casing section and which in use is located in the branch borehole.

In this known system the primary casing section is a tubular having a curved lower end which forms a lip which can be pulled against an existing casing inside the primary borehole by pulling or pushing the branch casing section into the branch borehole. As a result the tubular wall of the primary casing section is pulled against the wall of the existing casing to provide a seal that covers the window that has been cut into the existing casing at the location where the branch borehole intersects the primary borehole.

Soviet Union patent specification SU-663825 discloses another sealing system where a branch casing is welded to a primary casing section that is formed by a corrugated sleeve which is expanded downhole by an expansion mandrel.

International patent application WO 9403699 discloses the use of a primary casing section that is made of a memory alloy which is expanded by applying heat to provide a fluid-tight juncture.

A disadvantage of the known sealing systems is that they require the use of a primary casing section which is complex and expensive to make, that they require complex installation procedures and that the juncture seal provided can be prone to leakage.

It is an object of the present invention to provide a system for sealing the intersection between a primary and branch borehole which can be made and installed in a cost effective manner and which provides an effective seal.

SUMMARY OF THE INVENTION

The system according to the present invention comprises a primary casing section which in use is located in the primary borehole in the region of the branchpoint and a branch casing section which in use is located in the branch borehole, wherein the branch casing is secured to the primary casing section and the primary casing section is a tubular which defines a slant surface which is adapted to cooperate with a slant surface of a wedge-shaped element.

The presence of said slant surface allows the primary casing section to be pressed towards the area of the wall of the primary borehole surrounding the branchpoint by the wedge-shaped element which is placed in the primary borehole adjacent to the primary casing section at least at the time when the primary casing section is being installed.

Preferably, the system further comprises a wedge-shaped element which is formed by a whipstock which in use is located in the primary well adjacent to the primary casing section such that a slant surface at one end of the wedge-shaped element faces the slant surface of the primary casing section.

The whipstock may be a conventional solid whipstock which is removed or drilled out after the installation procedure. Alternatively, the whipstock may have a soft core which is drilled out or otherwise removed after the installation procedure.

However, it is preferred that the whipstock is a tubular having substantially the same outer diameter as the primary casing section and that it has a slant surface that intersects a central axis of the tubular wall of the whipstock at substantially the same angle as the angle of intersection between the slant surface of the primary casing section and a central axis of the primary casing section.

It is also preferred that when in use the hollow whipstock is located under the primary casing section and the whipstock has a smaller internal width than the outer width of a nose section of the branch casing section and the whipstock is arranged in the primary borehole at least partly under the intersection with the branch borehole and oriented such that when the branch casing section is lowered through the primary well the nose section thereof will be deflected by the slant surface of the whipstock into the branch borehole.

To further improve sealing the outer surfaces of the primary casing section and whipstock may be provided with a sealing agent and during installation the primary casing section and whipstock may be pressed on to each other at a selected axial force. By arranging the slant surfaces of the primary casing section and whipstock at a relatively small acute angle relative to the central axis thereof a wedge is created which maintains a continuous radial force to said section and whipstock also after the exertion of the axial force has stopped. The slant surfaces may be ratchet to aid in the locking process.

These and other features, objects and advantages of the system according to the invention will be described in the following detailed description and drawings.

DETAILED DESCRIPTION

Figure 1:
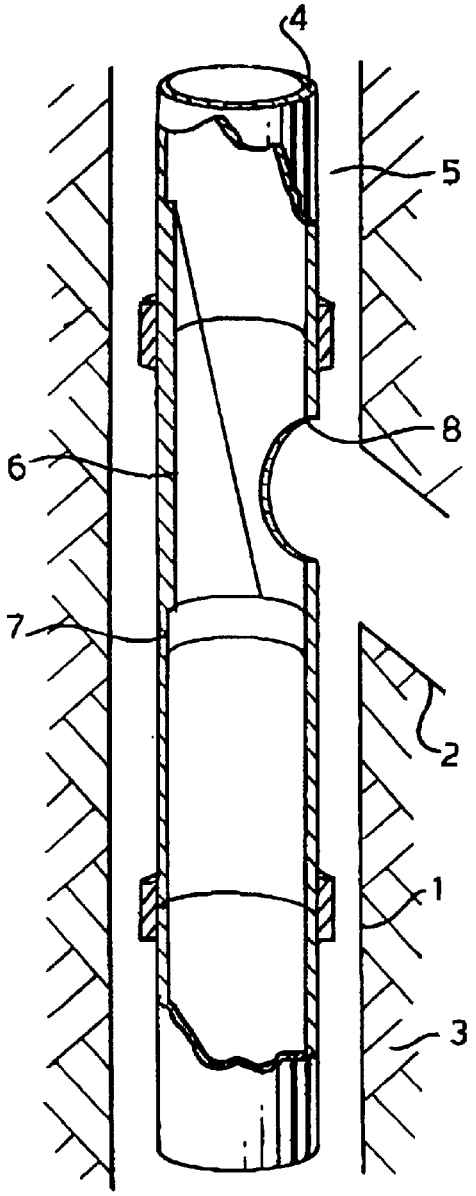
FIG. 1 is a schematic longitudinal sectional view of a primary borehole at the point of intersection with a branch borehole.

Referring now to FIG. 1 there are shown the contours of a substantially vertical primary borehole 1 and of an inclined branch borehole 2, which boreholes 1 and 2 are drilled through an underground formation 3.

A casing string 4 has been installed within the primary borehole 1 and cemented in place by an annular body of cement 5.

A hollow whipstock 6 has been installed within the casing string 4 on top of a packer 7.

A hole 8 has been milled in the wall of the casing string 4, possibly by a milling device (not shown) which is deflected by the hollow whipstock 6. After milling the hole 8 the branch borehole 2 is drilled into the formation 3 using a drilling device (not shown) which is deflected by the whipstock 6 away from the primary borehole 1, so that the drilling device drills the branch borehole 2.

Figure 2:
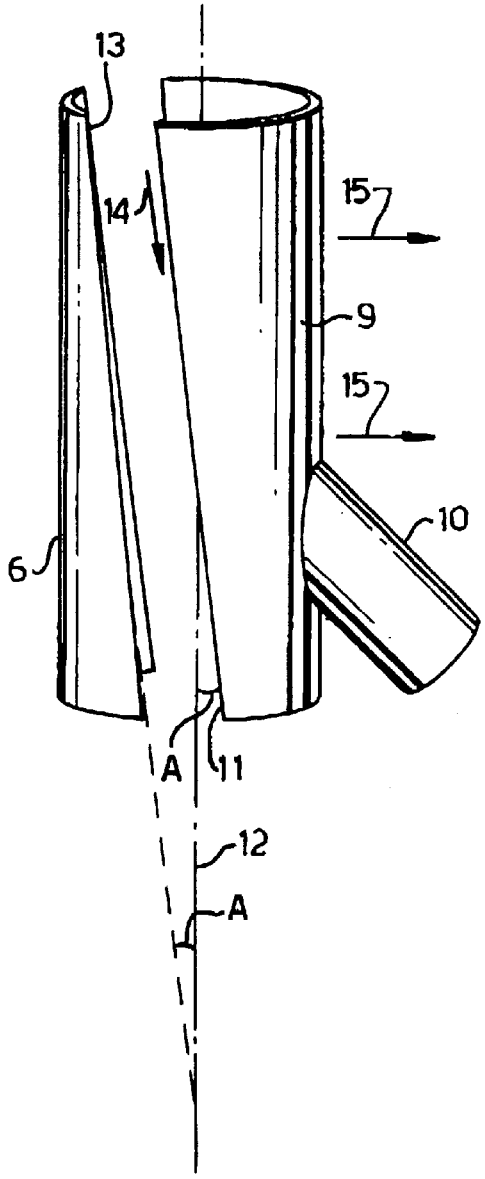
FIG. 2 is a schematic exploded view of a sealing system according to the invention.

After retrieval of the drilling device from the primary borehole a primary casing section 9 to which a branch casing section 10 has been welded in the manner shown in FIG. 2 is lowered through the primary borehole 1.

Once a nose section (not shown) of the branch casing section 10 hits the hollow whipstock 6 the nose section is deflected by the whipstock 6 into the branch borehole 2. To ensure that the nose section is deflected smoothly into the branch borehole 2 the nose section may have a larger width than the rest of the branch casing section 10. The nose section may be equipped with a spiralling outer rib which induces the branch casing section 10 to rotate the primary casing section 9 when the nose section is deflected by the hollow whipstock 6 such that the primary casing section obtains a desired orientation which is illustrated in FIG. 2 relative to the whipstock.

The primary casing section 9 is a tubular which defines a substantially flat slant surface 11, which lies in a plane (not shown) that intersects a central axis 12 of the tubular at an acute angle A.

In the example shown the hollow whipstock 6 and the primary casing section 9 have been cut from a single pipe section which has been cut into two sections such that the slant surfaces 11 and 13 lie in the plane of separation. Therefore also the hollow whipstock 6 comprises a slant surface 13 which lies in a plane (not shown) that intersects the central axis 12 at the same acute angle A as the slant surface 11 of the primary casing section 9. Since the plane of intersection cannot be easily depicted in the perspective view of FIG. 2 the angle A has been depicted as the angle between the central axis 12 and the slant surfaces 11 and 13 which involves a slight inaccuracy which will be understood by those skilled in the art.

Once the primary casing section 9 reaches the hollow whipstock 6 it will be pulled by the branch casing section 10 into the position shown in FIG. 2 in which the slant surface 11 of the primary casing section 9 faces and slides downwards along the slant surface 13 of the hollow whipstock 6 as illustrated by arrow 14.

As a result of this sliding movement the primary casing section 9 is pushed laterally into the direction of arrows 15 so that in the situation shown in FIG. 1 the primary casing section is pushed against the inner surface of the casing string 4 and thereby seals the window 8 that has been milled at the branchpoint.

Preferably, the angle A should be sufficiently small, for example less than 10°, to avoid that the primary casing section 9 slides back in upward direction after the installation procedure. During installation the axial downward force exerted on the primary casing section 9 should exceed a pre-set minimum value to ensure that the primary casing section 9 is firmly pressed against the casing string 4 in the region of the window 8. This could be achieved by hammering the primary casing section 9 downwards during installation.

Preferably the outer surfaces of the hollow whipstock 6 and of the primary and branch casing sections 9 and 10 are covered by a sealing agent to further enhance the seal provided by the system according to the invention. If the sealing agent also provides a bond between the casing string 4 and the primary casing section 9 the hollow whipstock 6 could be removed after the installation procedure, for example by a milling device. However, for most applications it is preferred that the whipstock 9 remains in place.

Preferably the whipstock 6 and the primary and branch casing sections 9 and 10 are made of steel, but, if desired, they can also be made of other metals or materials. After installation, the central axis 12 of the primary casing section 9 and of the hollow whipstock 6 will be substantially co-axial to the longitudinal axis of the primary borehole 1.

It will be understood that the system according to the invention can be used in a primary borehole 1 in which no casing string has been installed. In such case the hollow whipstock 6 and primary casing section 9 will be pressed against the borehole wall which is thereby further stabilized against caving in.

Figure 3:
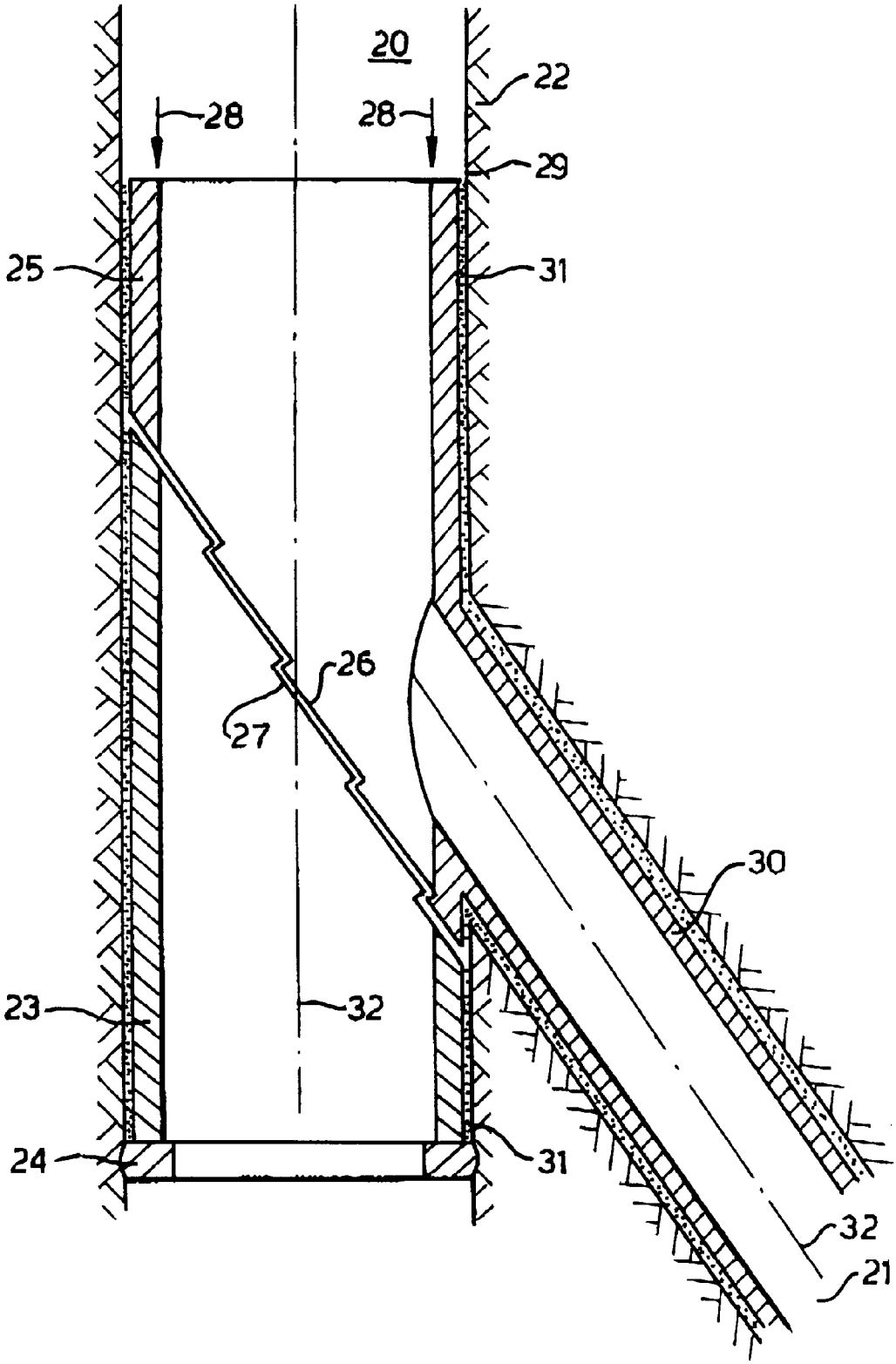
FIG. 3 is a longitudinal sectional view of an alternative embodiment of a sealing system according to the invention in an underground borehole.

Referring now to FIG. 3 there is shown an uncased primary borehole 20 and a branch borehole 21, which have been drilled into an underground rock formation 22. A hollow whipstock 23 has been installed inside the primary borehole 20 on top of a resilient locking ring 24 which presses itself into the formation 22.

A primary casing section 25 is mounted on top of the hollow whipstock 23. The primary casing section 25 and the hollow whipstock comprise complementary slant surfaces 26 and 27, respectively, that have steps that allow one member to ratchet into engagement with a corresponding member so that when the primary casing section 25 is pushed down in the direction of arrows 28 on top of the hollow whipstock 23 the primary casing section 25 is locked in its position against the borehole wall 29.

The primary casing section 25 carries a branch casing section 30. The outer surfaces of the primary and branched casing sections 25 and 30 and of the hollow whipstock 23 are provided with a sealing agent 31 which fills the annular spaces between these tubular elements and the surrounding formation 22.

In FIG. 3 the branch casing section 30 is an elongate liner that extends along a substantial part of the branch borehole 21. It will be understood that in the example shown the primary and branch casing sections 25 and 30 must be sufficiently flexible to them to be lowered to the branchpoint. In many well systems, however, the angle at which the central axis 32 of the branch borehole 31 intersects the central axis 32 of the primary borehole and also the angle at which the slant surfaces 26 and 27 are oriented relative to said central axis 32 is substantially smaller than in the example shown, in which case the requirement for clearance during the lowering procedure is alleviated.

Both in a cased and uncased primary borehole the system according to the invention provides a cheap, easily installable, effective and reliable seal for the branchpoint where the branch borehole intersects the primary borehole.

We claim:

1. A system for sealing the intersection between a primary borehole and a branch borehole, comprising a primary casing section which in use is located in the primary borehole in the region of the branchpoint;

a branch casing section which in use is located in the branch borehole; and a wedge-shaped element which in use is located in the primary well adjacent to the primary casing section such that a slant surface at one end of the wedge-shaped element faces the slant surface of the primary casing section;

wherein the branch casing section is secured to the primary casing section and the primary casing section is tubular and defines a slant surface which is adapted to cooperate with a slant surface of a wedge-shaped element; and wherein the slant surfaces of the primary casing section and of the wedge-shaped element have steps that allow one member to ratchet into engagement with a corresponding member.

2. The system of claim 1, wherein the wedge-shaped element is a hollow whipstock which has a slant surface that intersects a central axis of a tubular wall of the whipstock at substantially the same angle as the angle of intersection between the slant surface of the primary casing section and a central axis of the primary casing section.

3. The system of claim 2, wherein when in use the whipstock is located under the primary casing section and the whipstock has a smaller internal width than the outer width of a nose section of the branch casing section and the whipstock is arranged in the primary borehole at least partly under the intersection with the branch borehole and oriented such that when the branch casing section is lowered through the primary well the nose section thereof will be deflected by the slant surface of the whipstock into the branch borehole.

4. The system of claim 1, wherein the primary casing section and the wedge-shaped element are installed within a casing string inside the primary borehole, and a window is present in the wall of said casing string at the point of intersection with the branch borehole.

5. The system of claim 1, wherein the outer surfaces of the primary casing section and wedge-shaped element are provided with a sealing agent.

6. The system of claim 1, wherein the primary casing section and wedge-shaped element are installed inside the primary borehole and have during installation been pressed on to each other during installation at a selected axial force or stroke.

* * * * *